US006328435B1

(12) United States Patent
Ono et al.

(10) Patent No.: US 6,328,435 B1
(45) Date of Patent: Dec. 11, 2001

(54) INK JET HEAD AND INK JET RECORDING DEVICE

(75) Inventors: Masahiro Ono; Masayuki Sasaki; Akihiko Miyaki; Akira Iwaishi; Takumi Kawamura, all of Kawasaki (JP)

(73) Assignee: Fujitsu, Ltd., Kawasaki (JP)

( * ) Notice: Subject to any disclaimer, the term of this patent is extended or adjusted under 35 U.S.C. 154(b) by 0 days.

(21) Appl. No.: 09/276,794

(22) Filed: Mar. 26, 1999

(30) Foreign Application Priority Data

Aug. 3, 1998 (JP) ..... 10-219076

(51) Int. Cl.[7] ..... B41J 2/045; B41J 2/05
(52) U.S. Cl. ..... 347/70; 347/65
(58) Field of Search ..... 347/70, 94, 71, 347/54, 68, 65

(56) References Cited

U.S. PATENT DOCUMENTS 4,367,480 * 1/1983 Kotoh ..... 347/94
5,774,145 * 6/1998 Morita et al. ..... 347/43
5,971,527 * 10/1999 Peeters et al. ..... 347/65
6,010,209 * 1/2000 Kitahara ..... 347/71
6,164,759 * 12/2000 Fujii et al. ..... 347/54

FOREIGN PATENT DOCUMENTS 55-90374 7/1980 (JP) .

* cited by examiner

*Primary Examiner*—Thinh Nguyen
(74) *Attorney, Agent, or Firm*—Armstrong, Westerman, Hattori, McLeland & Naughton, LLP

(57) ABSTRACT

An ink jet head including a piezoelectric element having a displacing portion, a pressure chamber plate bonded to the piezoelectric element for defining a common ink chamber and a plurality of pressure chambers in cooperation with the piezoelectric element, and a nozzle plate bonded to the piezoelectric element and the pressure chamber plate and having a plurality of nozzles respectively communicating with the plurality of pressure chambers. Each pressure chamber is connected to the common ink chamber through a plurality of ink supply channels each having a substantially square cross-section.

11 Claims, 10 Drawing Sheets

INK JET HEAD AND INK JET RECORDING DEVICE

BACKGROUND OF THE INVENTION

1. Field of the Invention

The present invention relates to an ink jet head and an ink jet recording device.

2. Description of the Related Art

As a typical desktop nonimpact recording device, an ink jet recording device is now receiving attention for reasons of simple manufacturing and easy realization of full-color recording. The ink jet recording device has a recording head provided with a plurality of pressure chambers. A piezoelectric element or a resistive heating element, for example, as an actuator is built in each pressure chamber. Each pressure chamber is partially defined by a nozzle plate. The nozzle plate is formed with a plurality of nozzles respectively corresponding to the pressure chambers.

Ink is supplied from a common ink chamber through a plurality of ink supply channels respectively to the pressure chambers. When the actuator is driven, a pressure wave is generated in the corresponding pressure chamber to eject ink droplets from the corresponding nozzle, thus effecting dot recording on a recording medium such as a sheet of paper. In an existing ink jet head, the ratio of the mass of ink in each nozzle and the mass of ink in each ink supply channel is preferably set in the range of about 1:1 to about 1:2. Further, the diameter of each nozzle is preferably set to about 30 $\mu$m in consideration of printing speed, resolution, etc.

In the case of deciding the dimensions of each ink supply channel so as to meet the above conditions, the length of each ink supply channel is set to less than 100 $\mu$m provided that the sectional shape of each ink supply channel is circular or square. If the length of each ink supply channel is not less than 100 $\mu$m and the sectional shape thereof is square, the viscosity of ink in each ink supply channel is too small, causing a reduction in balance between the ink mass in each nozzle and the ink mass in the corresponding ink supply channel. Accordingly, in the case of setting the length of each ink supply channel to not less than 100 $\mu$m, the sectional shape of each ink supply channel is set oblong.

FIGS. 1A and 1B illustrate a prior art ink jet head having short ink supply channels each having a length less than 100 $\mu$m. Reference numeral 1 denotes a pressure chamber plate formed with a common ink chamber 2 and a plurality of pressure chambers 3. Each pressure chamber 3 is connected through an ink supply channel 4 to the common ink chamber 2. A nozzle plate 6 having a plurality of nozzles 7 is bonded to the pressure chamber plate 1. Reference numeral 8 denotes an ink droplet ejected from one of the nozzles 7. In the case that the thickness of a partition wall 5 formed between the common ink chamber 2 and each pressure chamber 3, that is, the length of each ink supply channel 4 is set to less than 100 $\mu$m as mentioned above, good flying characteristics or frequency characteristics of ink can be realized by setting the sectional shape of each ink supply channel 4 substantially square. However, in the case of integrally forming the common ink chamber 2, the pressure chambers 3, and the ink supply channels 4 on the pressure chamber plate 1, the manufacture of the ink jet head becomes difficult with the thickness of the partition wall 5 set to less than 100 $\mu$m.

FIGS. 2A and 2B illustrate another prior art ink jet head having long ink supply channels each having a length not less than 100 $\mu$m. As shown in FIG. 2A, the length of each ink supply channel 4', that is, the thickness of a partition wall 5' is set to not less than 100 $\mu$m. In this case, the sectional shape of each ink supply channel 4' is set oblong as shown in FIG. 2B in consideration of the balance between the ink mass in each nozzle 7 and the ink mass in the corresponding ink supply channel 4'.

As mentioned previously, in the case of integrally forming the common ink chamber, the pressure chambers, and the ink supply channels on the pressure chamber plate, the manufacture of the ink jet head becomes very difficult with the length of each ink supply channel, or the thickness of the partition wall between the common ink chamber and each pressure chamber set to less than 100 $\mu$m. Further, in the case of setting the length of each ink supply channel to not less than 100 $\mu$m, the sectional shape of each ink supply channel 4' becomes oblong as shown in FIG. 2B in consideration of the balance between the ink mass in each nozzle and the ink mass in the corresponding ink supply channel. However, when the sectional shape of each ink supply channel is oblong, a turbulent flow is likely to generate in each ink supply channel, causing a deterioration in flying characteristics or frequency characteristics of ink.

SUMMARY OF THE INVENTION

It is therefore an object of the present invention to provide an ink jet head which can be easily manufactured and can improve the flying characteristics of ink.

In accordance with an aspect of the present invention, there is provided an ink jet head comprising a piezoelectric element having a displacing portion; a pressure chamber plate bonded to the piezoelectric element for defining a common ink chamber and a plurality of pressure chambers in cooperation with the piezoelectric element; and a nozzle plate bonded to the piezoelectric element and the pressure chamber plate and having a plurality of nozzles respectively communicating with the plurality of pressure chambers; each of the plurality of pressure chambers being connected to the common ink chamber through a plurality of ink supply channels each having a substantially square cross-section.

Preferably, the displacing portion of the piezoelectric element comprises a plurality of individual electrodes embedded in the piezoelectric element and a plurality of ground electrodes embedded in the piezoelectric element in alternate relationship with the plurality of individual electrodes; each of the plurality of individual electrodes being connected to drive means. Preferably, the pressure chamber plate is formed by molding a thermosetting resin containing a filler, and the thermosetting resin has a coefficient of linear expansion of $15\times10^{-6}/°$ C. or less. More preferably, the thermosetting resin is a thermosetting epoxy resin, and the filler is silica ($SiO_2$). More preferably, 70–80 wt. % of silica is mixed in the thermosetting epoxy resin.

In accordance with another aspect of the present invention, there is provided an ink jet recording device comprising a housing; a platen mounted to the housing; a guide member mounted to the housing so as to extend substantially in parallel to the platen; a carriage movably mounted on the guide member; first drive means for driving the carriage; and a plurality of ink jet heads mounted on the carriage; each of the plurality of ink jet heads comprising a piezoelectric element having a displacing portion; a pressure chamber plate bonded to the piezoelectric element for defining a common ink chamber and a plurality of pressure chambers in cooperation with the piezoelectric element; a nozzle plate bonded to the piezoelectric element and the pressure chamber plate and having a plurality of nozzles respectively communicating with the plurality of pressure chambers; second drive means connected to the displacing portion of the piezoelectric element; and control means connected to the second drive means for controlling the second drive means; each of the plurality of pressure chambers being connected to the common ink chamber through two ink supply channels each having a substantially square cross-section.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1A:
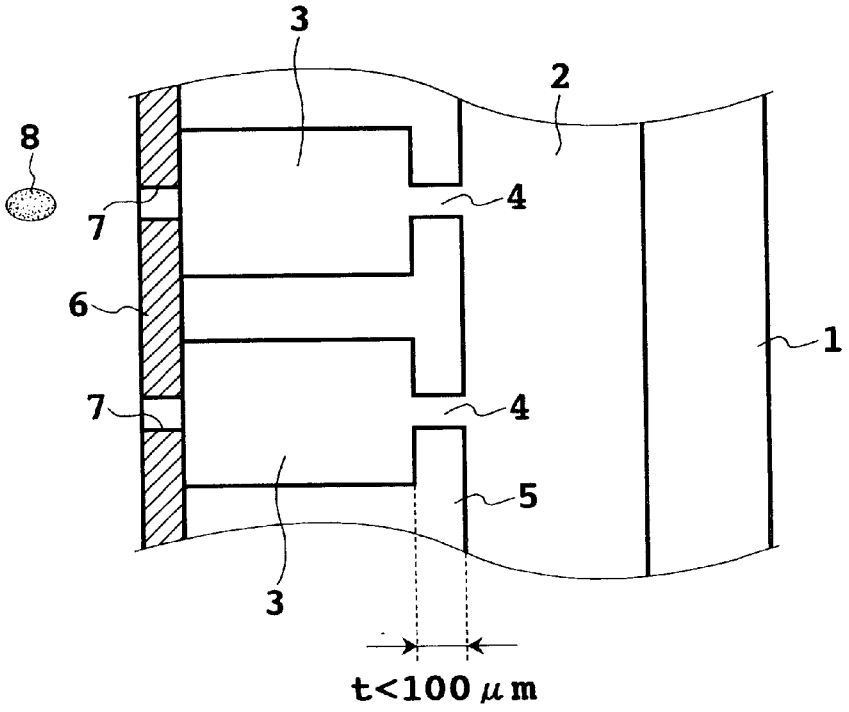
FIG. 1A PRIOR ART
FIG. 1A is a partially-sectional plan view of a prior art ink jet head having short ink supply channels.
Figure 1B:
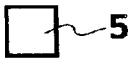
FIG. 1B PRIOR ART
FIG. 1B is a view showing a sectional shape of each ink supply channel shown in FIG. 1A.
Figure 2A:
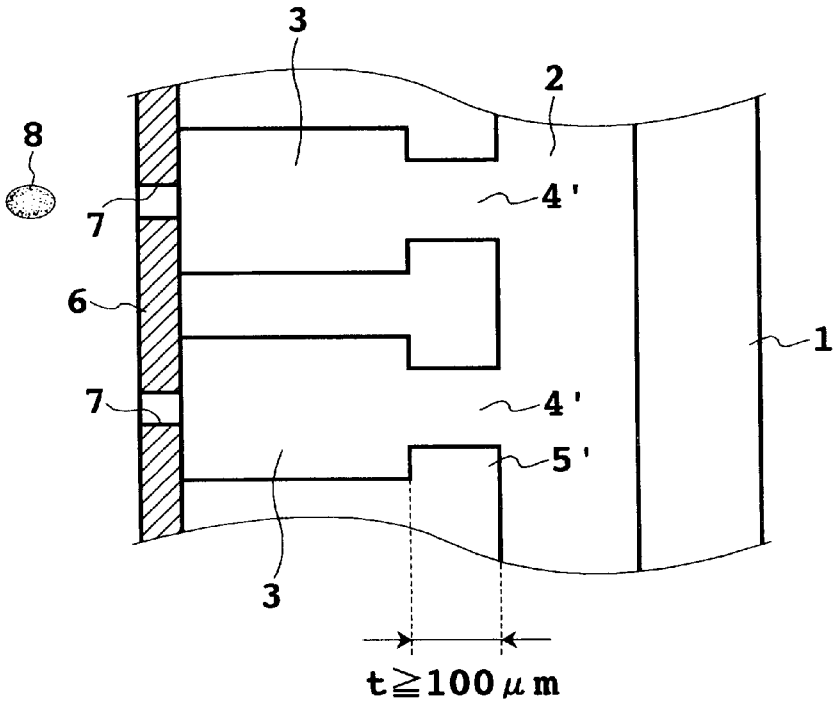
FIG. 2A PRIOR ART
FIG. 2A is a partially-sectional plan view of another prior art ink jet head having long ink supply channels.
Figure 2B:
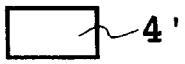
FIG. 2B PRIOR ART
FIG. 2B is a view showing a sectional shape of each ink supply channel shown in FIG. 2A.
Figure 3:
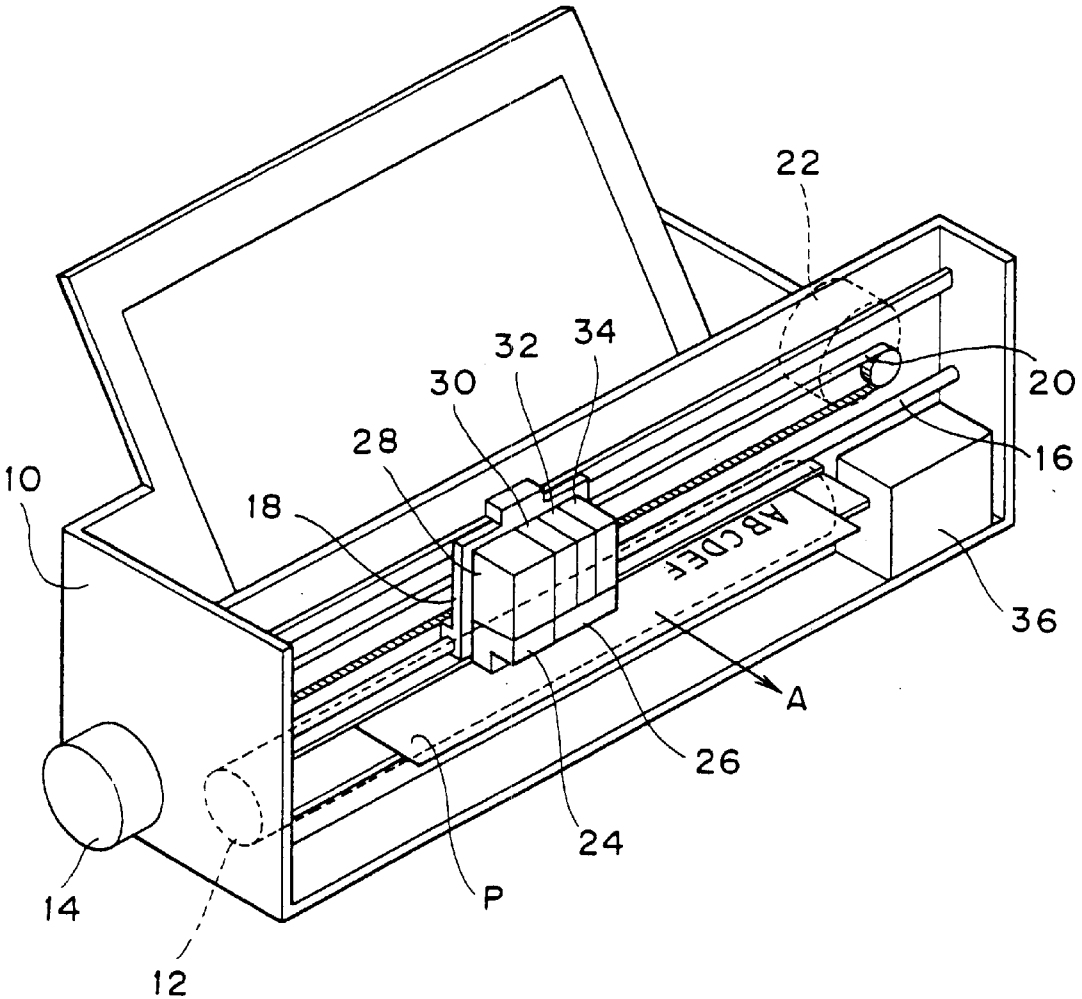
FIG. 3 is a perspective view of an ink jet recording device according to a preferred embodiment of the present invention.

Referring to FIG. 3, there is schematically shown a preferred embodiment of a color ink jet printer (recording device) according to the present invention. Reference numeral 10 denotes a housing of the color ink jet recording device. A platen 12 is rotatably provided in the housing 10. In a recording operation, the platen 12 is intermittently rotated by a drive motor 14 to thereby intermittently feed a recording sheet P of paper with a given feed pitch in a direction shown by an arrow A. A guide rod 16 is provided in the housing 10 of the color ink jet recording device so as to extend in parallel to the platen 12 on the upper side thereof, and a carriage 18 is slidably mounted on the guide rod 16.

The carriage 18 is fixed to an endless drive belt 20. The endless drive belt 20 is bidirectionally driven by a drive motor 22. Accordingly, the carriage 18 is reciprocated along the platen 12. A monochrome recording head 24 and a color recording head 26 each having the configuration of the ink jet head according to the present invention are mounted on the carriage 18. Actually, the color recording head 26 is composed of three heads for different colors. A black ink tank 28 is detachably mounted on the monochrome recording head 24, and color ink tanks 30, 32, and 34 are detachably mounted on the color recording head 26. A black ink is stored in the black ink tank 28. A yellow ink, a cyan ink, and a magenta ink are stored in the color ink tanks 30, 32, and 34, respectfully.

During reciprocation of the carriage 18 along the platen 12, the monochrome recording head 24 and the color recording head 26 are driven according to image data obtained from a word processor, personal computer, etc., thereby recording given characters, images, etc. on the recording sheet P. At stopping the recording operation, the carriage 18 is returned to a home position, at which a nozzle maintenance mechanism 36 is provided. The nozzle maintenance mechanism 36 includes a movable suction cap (not shown) and a suction pump (not shown) connected to the movable suction cap. When the monochrome recording head 24 and the color recording head 26 are returned to the home position, the suction cap comes into close contact with a nozzle plate of any of the monochrome recording head 24 and the color recording head 26, and the suction pump is then driven to suck the ink present in nozzles of the nozzle plate, thereby preventing clogging of the nozzles of the nozzle plate.

Figure 5:
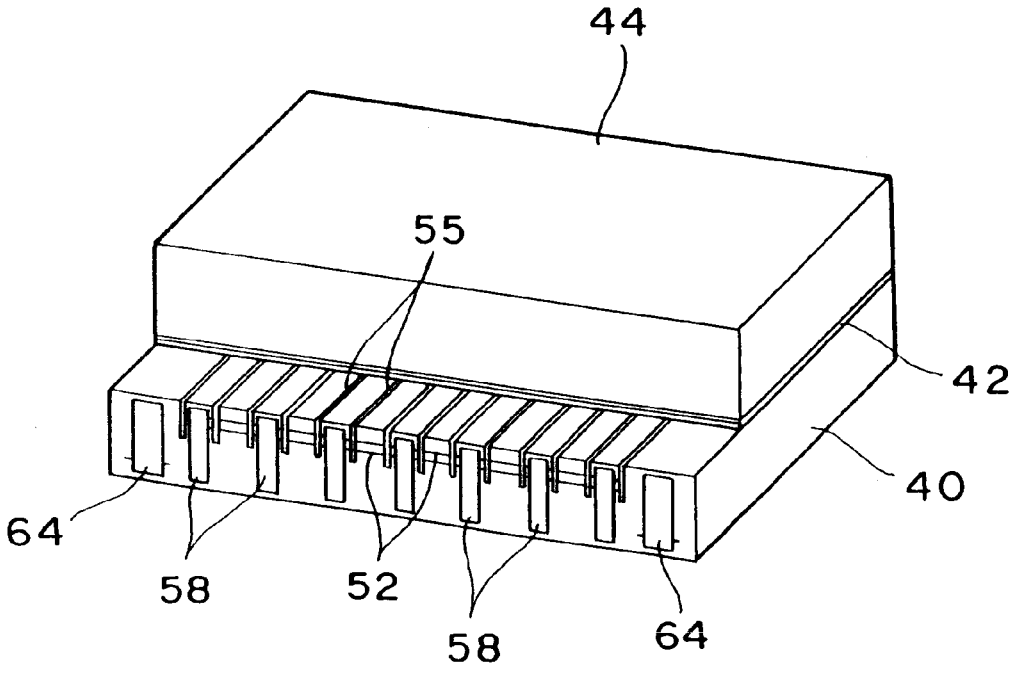
FIG. 5 is a rear perspective view of the ink jet head shown in FIG. 4.
Figure 6:
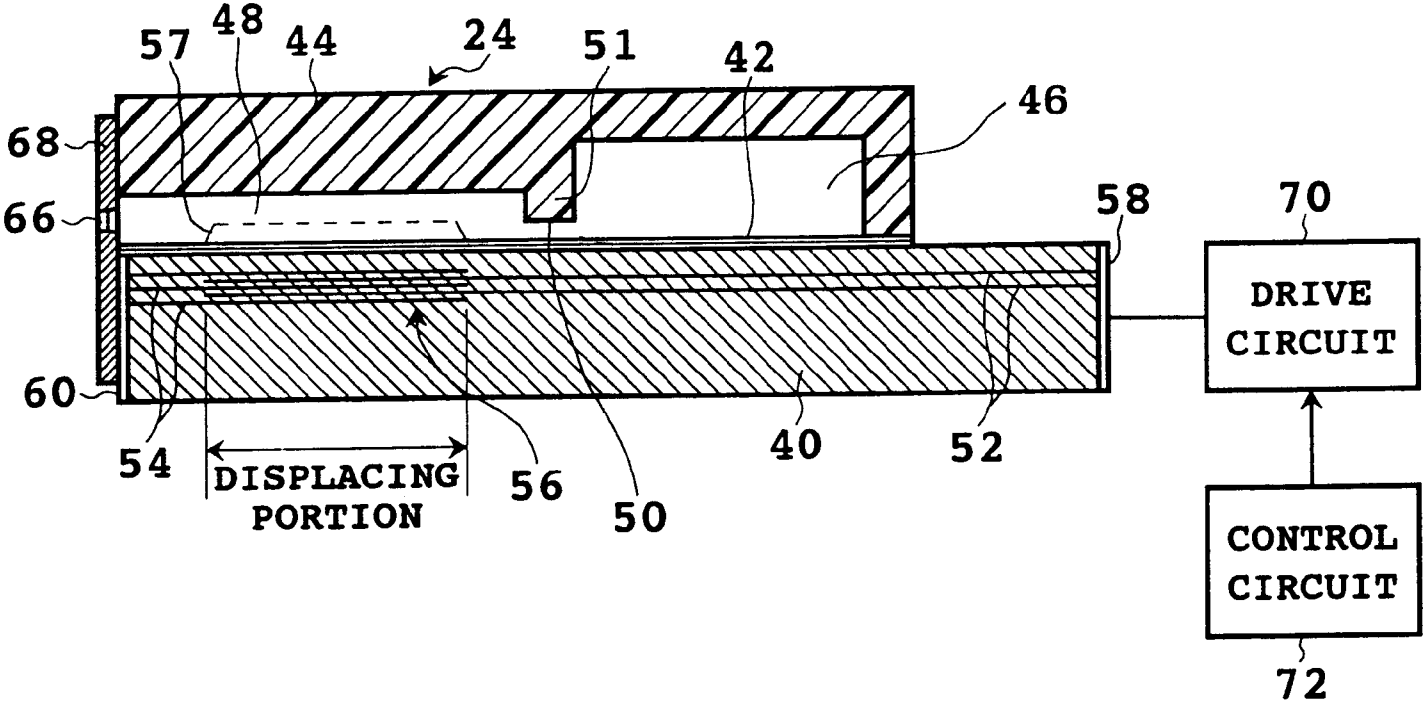
FIG. 6 is a sectional view of the ink jet head shown in FIG. 4.

The configuration of the monochrome ink jet head (monochrome recording device) 24 will now be described with reference to FIGS. 4 to 6. The color ink jet head (color recording device) 26 has the same configuration as that of the monochrome ink jet head 24. As best shown in FIG. 6, the ink jet head 24 includes a multilayer piezoelectric element 40. The multilayer piezoelectric element 40 is fabricated by stacking a plurality of green sheets formed of barium titanate ($BaTiO_3$), for example, embedding a plurality of individual electrodes 52 and a plurality of ground electrodes 54 in the stack of the green sheets, applying heat and pressure to the stack of the green sheets to integrate them together, and finally burning the integrated green sheets.

The piezoelectric element 40 has a displacing portion or active portion 56. In the displacing portion 56, the individual electrodes 52 and the ground electrodes 54 are alternately stacked in the piezoelectric element 40. As best shown in FIG. 5, each individual electrode 52 is separated into a plurality of electrode elements by a plurality of slits 55, so that any adjacent ones of the electrode elements of each individual electrode 52 are electrically insulated from each other by the intervening slit 55. Each electrode element of each individual electrode 52 is connected to an individual terminal 58 on the rear end surface of the piezoelectric element 40.

Figure 4:
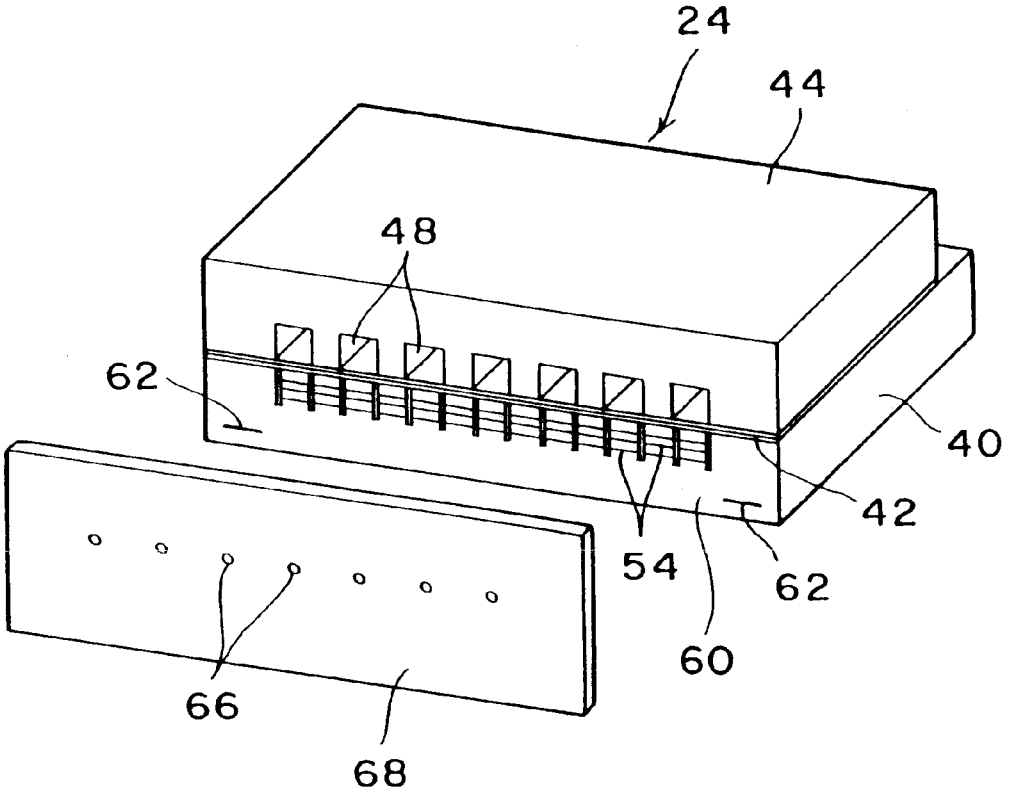
FIG. 4 is a partially-exploded front perspective view of an ink jet head included in the ink jet recording device shown in FIG. 3.

As shown in FIGS. 4 and 6, the front end surface of the piezoelectric element 40 is metallized as shown by reference numeral 60. Accordingly, each ground electrode 54 is connected through a pair of conductor patterns 62 embedded in the peizoelectric element 40 to a pair of ground terminals 64 on the rear end surface of the peizoelectric element 40 (see FIG. 5). Accordingly, each ground electrode 54 is grounded through the pair of ground electrodes 64. A pressure chamber plate 44 is bonded through a bonding member 42 to the upper surface of the piezoelectric element 40. The pressure chamber plate 44 is formed with a common ink chamber 46 and a plurality of pressure chambers 48 communicating with the common ink chamber 46. Each pressure chamber 48 is connected through a pair of ink supply channels 50 to the common ink chamber 46. The pressure chamber plate 44 is formed by molding a thermosetting epoxy resin containing a filler as will be hereinafter described.

A nozzle plate 68 having a plurality of nozzles 66 is bonded to the front end surfaces of the piezoelectric element 40 and the pressure chamber plate 44. The nozzle plate 68 is formed of stainless steel, for example. The nozzles 66 communicate with the pressure chambers 48, respectively. The common ink chamber 46, each ink supply channel 50, and each pressure chamber 48 are filled with ink. As shown in FIG. 6, each individual terminal 58 is connected to a drive circuit 70, and the drive circuit 70 is connected to a control circuit 72. Accordingly, a driving waveform to be applied to each individual electrode 52 is controlled by the control circuit 72.

Figure 7A:
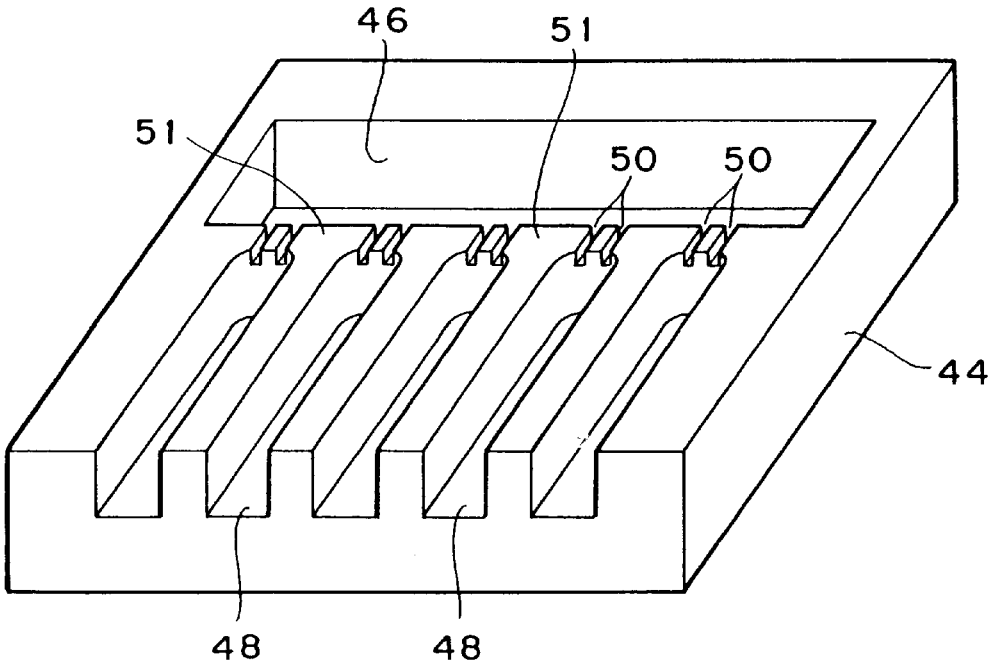
FIG. 7A is a perspective view of a pressure chamber plate included in the ink jet head shown in FIG. 4 as viewed from the lower side.
Figure 7B:
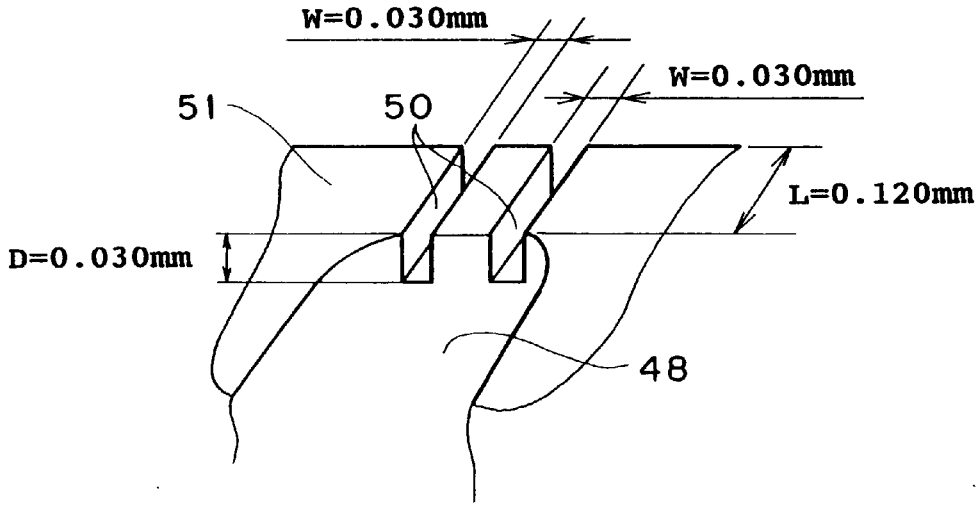
FIG. 7B is an enlarged perspective view for illustrating the dimensions of each ink supply channel shown in FIG. 7A.

Referring to FIG. 7A, there is shown a perspective view of the pressure chamber plate 44 as viewed from its lower surface. Each pressure chamber 48 is connected through the two ink supply channels 50 to the common ink chamber 46. Each ink supply channel 50 has a substantially square cross-section. The dimensions of each ink supply channel 50 are shown in FIG. 7B. The thickness of a partition wall 51 formed between the common ink chamber 46 and each pressure chamber 48, that is, the length L of each ink supply channel 50 is set to 0.120 mm, and the length of each side of the substantially square cross-section of each ink supply channel 50 is set to about 0.030 mm.

The particle quantity of ink to be ejected from each nozzle 66 is defined by the dimensions of each member constituting the ink jet head, that is, by the dimensions of each nozzle 66, the dimensions of each pressure chamber 48, the dimensions of each ink supply channel 50, etc. Further, the particle quantity of ink to be ejected from each nozzle 66 can be controlled by changing a driving waveform and a driving voltage to be applied to the corresponding individual electrode 52.

Figure 8A:
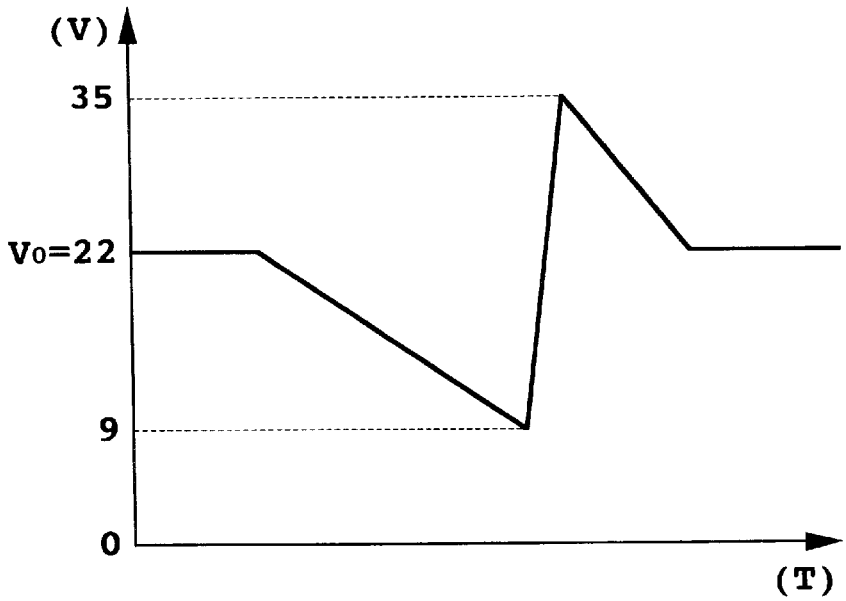
FIG. 8A is a graph showing a driving waveform to be applied to each individual electrode shown in FIG. 6 in the case of ejecting larger-sized ink particles.
Figure 8B:
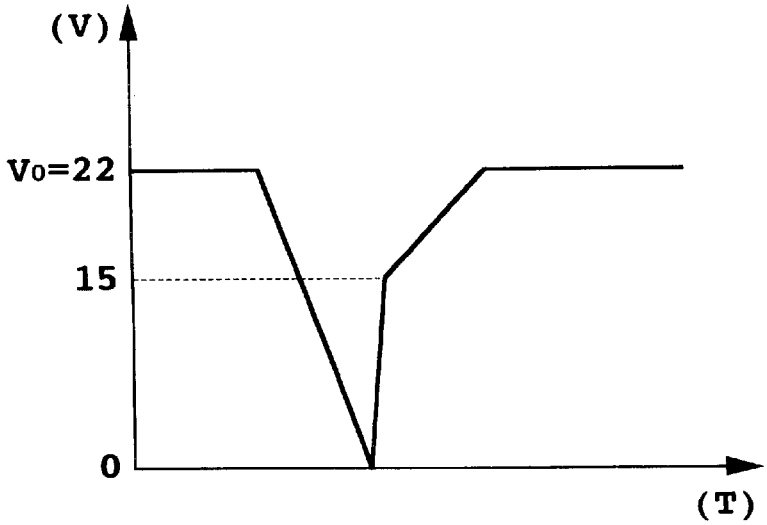
FIG. 8B is a graph showing a driving waveform to be applied to each individual electrode shown in FIG. 6 in the case of ejecting smaller-sized ink particles.

FIG. 8A shows a driving waveform to be applied to each individual electrode 52 in the case of ejecting larger-sized ink particles, and FIG. 8B shows a driving waveform to be applied to each individual electrode 52 in the case of ejecting smaller-sized ink particles. In FIGS. 8A and 8B, the horizontal axis represents time on the order of tens of microseconds. A base voltage $V_0$ of 22 volts is normally applied to each individual electrode 52, so that an ink surface position (meniscus) in each nozzle 66 is kept substantially flush with the outer surface of the nozzle plate 68.

In the case of ejecting larger-sized ink particles to obtain larger dot diameters to be recorded on a recording sheet, the applied voltage to each individual electrode 52 is gradually decreased from the base voltage $V_0$=22 volts to about 9 volts and next rapidly increased to about 35 volts in a short period of time. When the applied voltage is decreased to about 9 volts, the meniscus in each nozzle 66 is retracted toward the corresponding pressure chamber 48. When the applied voltage is next rapidly increased to about 35 volts, the corresponding displacing portion 56 of the piezoelectric element 40 is deformed as shown by a broken line 57 in FIG. 6, thereby generating a pressure in the corresponding pressure chamber 48. This pressure causes ejection of larger-sized ink particles from the corresponding nozzle 66.

In the case of ejecting smaller-sized ink particles from each nozzle 66 to obtain smaller dot diameters to be recorded on a recording sheet, a driving waveform as shown in FIG. 8B is applied to each individual electrode 52. The applied voltage to each individual electrode 52 is decreased from the base voltage $V_0$=22 volts to 0 volt and next rapidly increased to about 15 volts. When the applied voltage is decreased to 0 volt, the meniscus in each nozzle 66 is deeply retracted toward the corresponding pressure chamber 48. When the applied voltage is next rapidly increased to about 15 volts, smaller-sized ink particles are ejected from the corresponding nozzle 66.

Referring again to FIG. 7A, the formation of each ink supply channel 50 is most difficult in forming the pressure chamber plate 44 with given dimensions. Conventionally, each ink supply channel is formed by cutting, etching, etc. However, such forming methods are very difficult to carry out from the viewpoints of dimension reproduction and forming cost in mass production, so that these methods are unsuitable for mass production. To solve this problem, the present invention employs molding of a thermosetting epoxy resin containing a filler to form the pressure chamber plate 44. Preferably, 70–80 wt. % of silica ($SiO_2$) is mixed as the filler into a thermosetting epoxy resin. The material of the pressure chamber plate 44 is required to have a rigidity of 20 gigapascal (GPa) or more and a coefficient of linear expansion of $15\times10^{-6}$/° C. or less. These requirements are met by a thermosetting epoxy resin containing a filler, for example.

Various methods for preparing a mold required for resin molding of the pressure chamber plate 44 will be described below.

(a) Casting and Transfer Method

Figure 9A:
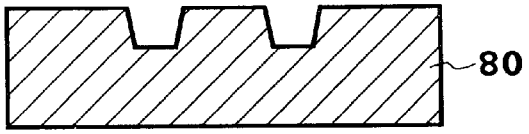
FIGS. 9A to 9D are sectional views showing a molding process using a transfer mold applicable to the manufacture of the ink jet head.
Figure 9B:
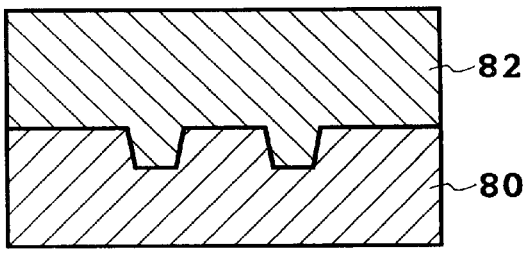
Figure 9C:
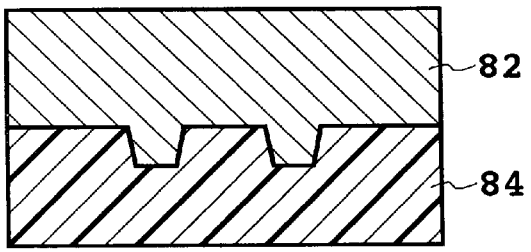
Figure 9D:
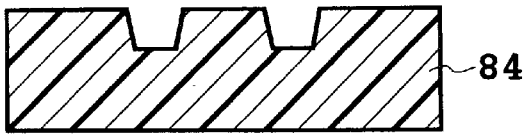

A master mold having the same shape as that of a product except the ink supply channels is first formed from cemented carbide by cutting, electrical discharge machining, etc. Then, the master mold is cut by a dicing saw to form the ink supply channels, thereby obtaining a master mold 80 as shown in FIG. 9A. By using the master mold 80, beryllium-copper alloy is subjected to pressure casting to form a transfer mold 82 as shown in FIG. 9B. The reason why the master mold 80 is formed from cemented carbide is to suppress generation of a burr in the cutting step using the dicing saw. By using the transfer mold 82, resin molding is carried out to form a molded product 84 as shown in FIG. 9C. Finally, the transfer mold 82 is separated to obtain the molded product 84 as shown in FIG. 9D.

(b) Nickel Electroforming Method

Brass is worked into the same shape as that of a product except the ink supply channels and is next cut by wire cutting to form the ink supply channels, thereby obtaining a master mold. The reason why the ink supply channels are formed by wire cutting is to suppress generation of a burr in the cutting step. Then, the master mold is immersed into a nickel electroforming bath at about 60° C. to form a transfer mold. According to this method, the transfer mold can be prepared with very high accuracy, but much time is required for preparation of the transfer mold.

(c) Profile Grinding Method

Figure 10A:
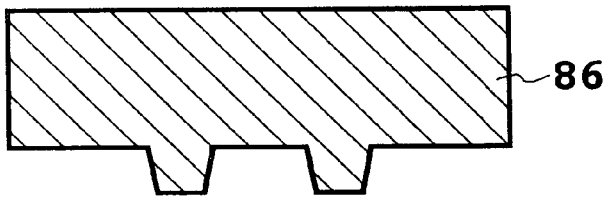
FIGS. 10A to 10C are sectional views showing another molding process using a profile ground mold applicable to the manufacture of the ink jet head.
Figure 10B:
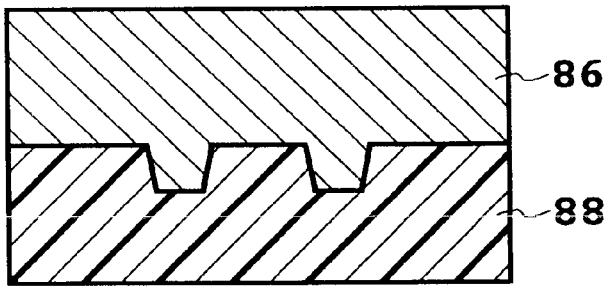
Figure 10C:
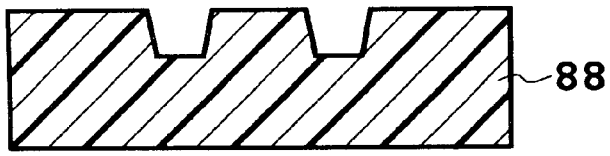

A shape inverted from the shape of a product is formed by a diamond cutter or the like, and the ink supply channels are next formed by profile cutting with a dicing saw to form a profile ground mold 86 as shown in FIG. 10A. By using the profile ground mold 86, resin molding is carried out to form a molded product 88 as shown in FIG. 10B. Finally, the profile ground mold 86 is separated to obtain the molded product 88 as shown in FIG. 10C.

Various molding methods adoptable for production of the pressure chamber plate 44 will now be described.

(a) Compression Molding Method

A molded product is manufactured by compression molding including the following steps.

(1) Formation of a Tablet Having a Shape Conforming with the Shape of a Product

A given quantity of thermosetting resin to be molded is preliminarily measured and next preformed to obtain a tablet. This step contributes to improvement in molding efficiency.

(2) Preheating

The tablet obtained by preforming above is put into a molding machine. Before molding, the tablet is preheated to a temperature (60° C. to 100° C.) lower than a molding temperature. This preheating is effected preferably by using a high-frequency preheater. By using the high-frequency preheater, the whole of the tablet can be heated well uniformly to thereby shorten a preheating period and accordingly improve the efficiency.

(3) Compression Molding with Heat

Heat and pressure are applied to the tablet preheated above to perform molding with accelerated curing.

(4) Removal of Molded Resin

The molded resin after curing is removed from the molding machine by using a brass spatura or by blowing with compressed air.

(5) Finishing of Molded Resin

The molded resin removed from the molding machine is finished by removing a molded part (fin or flash) protruding from a mated spacing between molds or dies in the molding step, and next buffing the surface of the molded product.

(6) Reheating (Annealing)

The molded product is sandwiched between plates of ceramic or the like and heated to about 170° C., thereby removing warpage or the like of the molded product.

(b) Injection Molding Method

An injection molding machine is used to perform automatic molding of a thermosetting resin continuously with high accuracy. The injection molding method has many advantages such as high efficiency and good dimensional accuracy of the product.

(c) Transfer Molding Method

A preheated tablet of resin is extruded under pressure through a thin nozzle into a mold. The mold is heated to cure the resin in the mold, thereby forming a molded product. The transfer molding method has many advantages over the compression molding method, but has a defect that the structure of the mold is complex.

The above-mentioned mold preparing methods and molding methods may be arbitrarily combined according to an allowable dimensional accuracy of product and a manufacturing cost, and an optimum combination of these methods may be selected in consideration of the property of each method.

In the ink jet head according to this preferred embodiment, the pressure chamber plate 44 is formed by molding a thermosetting epoxy resin containing silica. Accordingly, two ink supply channels each having a substantially or normally formed square cross-section wherein the side walls diverge slightly from the base as shown in FIGS. 9A and 9D and 10A to 10C can be formed for each pressure chamber with good dimension reproduction. Further, mass production can be suitably adopted because resin molding is carried out. Since the cross section of each ink supply channel is substantially square, the generation of a turbulent flow in each ink supply channel can be prevented to thereby improve the flying characteristics or frequency characteristics of ink.

According to the present invention, it is possible to provide an ink jet head which can be easily manufactured and can improve the flying characteristics of ink.

What is claimed is:

1. An ink jet head comprising:

a piezoelectric element having a displacing portion;

a pressure chamber plate formed of a moldable material bonded to said piezoelectric element for defining a common ink chamber and a plurality of pressure chambers in cooperation with said piezoelectric element; and a nozzle plate bonded to said piezoelectric element and said pressure chamber plate and having a plurality of nozzles respectively communicating with said plurality of pressure chambers;

wherein each of said plurality of pressure chambers is connected to said common ink chamber through a plurality of ink supply channels each having a substantially square cross-section wherein opposing side walls are divergently related to a base wall.

2. An ink jet head according to claim 1, wherein each of said plurality of ink supply channels has a length not less than 100 $\mu$m.

3. An ink jet head according to claim 1, further comprising:

drive means connected to said displacing portion of said piezoelectric element for driving said displacing portion; and control means connected to said drive means for controlling said drive means.

4. An ink jet head according to claim 3, wherein said displacing portion of said piezoelectric element comprises a plurality of individual electrodes embedded in said piezoelectric element and a plurality of ground electrodes embedded in said piezoelectric element in alternate relationship with said plurality of individual electrodes; and wherein each of said plurality of individual electrodes is connected to said drive means.

5. An ink jet head comprising:

a piezoelectric element having a displacing portion;

a pressure chamber plate bonded to said piezoelectric element for defining a common ink chamber and a plurality of pressure chambers in cooperation with said piezoelectric element;

a nozzle plate bonded to said piezoelectric element and said pressure chamber plate and having a plurality of nozzles respectively communicating with said plurality of pressure chambers;

wherein each of said plurality of pressure chambers is connected to said common ink chamber through a plurality of ink supply channels each having a substantially square cross-section; and wherein said pressure chamber plate is formed by molding a thermosetting resin containing a filler, said thermosetting resin having a coefficient of linear expansion of $15\times10^{-6}$/° C. or less.

6. An ink jet head according to claim 5, wherein said thermosetting resin is a thermosetting epoxy resin, and said filler is silica.

7. An ink jet head according to claim 6, wherein 70–80 wt. % of said silica is mixed in said thermosetting epoxy resin.

8. An ink jet recording device comprising:

a housing;

a platen mounted to the housing;

a guide member mounted to the housing so as to extend substantially in parallel to the platen;

a carriage movably mounted on the guide member;

first drive means for driving the carriage; and a plurality of ink jet heads mounted on the carriage;

each of the plurality of ink jet heads comprising:

a piezoelectric element having a displacing portion;

a pressure chamber plate formed of a moldable material bonded to the piezoelectric element for defining a common ink chamber and a plurality of pressure chambers in cooperation with the piezoelectric element;

a nozzle plate bonded to the piezoelectric element and the pressure chamber plate and having a plurality of nozzles respectively communicating with the plurality of pressure chambers;

second drive means connected to the displacing portion of the piezoelectric element; and control means connected to the second drive means for controlling the second drive means;

wherein each of the plurality of pressure chambers is connected to the common ink chamber through two ink supply channels each having a substantially square cross-section in which opposing side walls of said supply channels are divergently related to a base wall thereof.

9. An ink jet recording device according to claim 8, wherein said displacing portion of said piezoelectric element comprises a plurality of individual electrodes embedded in said piezoelectric element and a plurality of ground electrodes embedded in said piezoelectric element in alternate relationship with said plurality of individual electrodes; and wherein each of said plurality of individual electrodes is connected to said third drive means.

10. An ink jet recording device 4 comprising:

a housing;

a platen mounted to the housing;

a guide member mounted to the housing so as to extend substantially in parallel to the platen;

a carriage movably mounted on the guide member;

first drive means for driving the carriage; and a plurality of ink jet heads mounted on the carriage;

each of the plurality of ink jet heads comprising:

a piezoelectric element having a displacing portion;

a pressure chamber plate bonded to the piezoelectric element for defining a common ink chamber and a plurality of pressure chambers in cooperation with the piezoelectric element;

a nozzle plate bonded to the piezoelectric element and the pressure chamber plate and having a plurality of nozzles respectively communicating with the plurality of pressure chambers;

second drive means connected to the displacing portion of the piezoelectric element; and control means connected to the second drive means for controlling the second drive means;

wherein each of the plurality of pressure chambers is connected to the common ink chamber through two ink supply channels each having a substantially square cross-section; and wherein said pressure chamber plate is formed by molding a thermosetting resin containing a filler, said thermosetting resin having a coefficient of linear expansion of $15\times10^{-6}/°$ C. or less.

11. An ink jet head comprising:

a piezoelectric element;

a pressure chamber plate bonded to said piezoelectric element and cooperating therewith to define a plurality of pressure chambers and a common ink chamber communicating with each of said pressure chambers;

a nozzle plate bonded to said piezoelectric element and said pressure chamber plate and having a plurality of nozzles communicating respectively with each of said pressure chambers; and a displacing portion including an arrangement of individual electrodes and ground electrodes embedded in said piezoelectric element, said individual electrodes and said ground electrodes extending in an interacting relation adjacent each of said pressure chambers.

* * * * *